US010010178B2

(12) United States Patent
Maughan

(10) Patent No.: US 10,010,178 B2
(45) Date of Patent: Jul. 3, 2018

(54) STACKING CHAIR

(71) Applicant: Mity-Lite, Inc., Orem, UT (US)

(72) Inventor: Sterling Maughan, Orem, UT (US)

(73) Assignee: Mity-Lite, Inc., Orem, UT (US)

( * ) Notice: Subject to any disclaimer, the term of this patent is extended or adjusted under 35 U.S.C. 154(b) by 46 days.

(21) Appl. No.: 15/340,711

(22) Filed: Nov. 1, 2016

(65) Prior Publication Data

US 2017/0127836 A1 May 11, 2017

Related U.S. Application Data

(60) Provisional application No. 62/251,399, filed on Nov. 5, 2015.

(51) Int. Cl.
*A47C 3/04* (2006.01)
*A47C 7/40* (2006.01)

(52) U.S. Cl.
CPC . *A47C 3/04* (2013.01); *A47C 7/40* (2013.01)

(58) Field of Classification Search
CPC .. A47C 3/04; A47C 3/045; A47C 7/40; A47C 7/16; A47C 7/22; A47C 4/02; A47C 4/03; A47C 4/028; A47C 4/024; A47C 4/025
USPC ..... 297/239
See application file for complete search history.

(56) References Cited

U.S. PATENT DOCUMENTS 1,408,114 A * 2/1922 Mathieu ..... A47C 3/04 108/91
1,753,623 A * 4/1930 Porche ..... A47C 3/04 297/239
2,011,067 A * 8/1935 McKee ..... A47C 3/04 228/153
2,098,888 A 3/1937 Schadler
2,126,439 A 8/1938 Zetbee
2,699,814 A 1/1955 Kahm
2,806,517 A 4/1955 Dexter et al.
2,709,484 A * 5/1955 Lamb ..... A47C 3/04 297/239
2,874,755 A 2/1959 Smith
3,031,227 A 4/1962 Van Buren, Jr.
D194,031 S 11/1962 Jensen et al.
3,087,755 A 4/1963 Boman
3,111,344 A 11/1963 Hoven et al.
(Continued)

FOREIGN PATENT DOCUMENTS

CA 8503 A 8/1878

OTHER PUBLICATIONS

Gasser Chair Company Inc, "Product Summary Catalog", Gasser Chair Company, Inc., 1999, 10 pages, Youngstown, OH.
(Continued)

*Primary Examiner* — Mark R Wendell
(74) *Attorney, Agent, or Firm* — Thorpe, North & Western, LLP

(57) ABSTRACT

A stacking chair system with a plurality of stacking chairs each comprising a seat frame and a backrest frame, and a pair of side legs on each side of the seat frame. A pair of side supports extends from a top of the backrest to a front of the seat. An upper chair is stackable upon a lower chair, with the pair of side legs of the upper chair inside the pair of side supports of the lower chair, and the pair of side legs of the lower chair inside the pair of legs of the upper chair.

20 Claims, 10 Drawing Sheets

(56) References Cited

U.S. PATENT DOCUMENTS 3,123,399 A 3/1964 Wilson
3,133,762 A 5/1964 Newman
3,159,425 A 12/1964 Engstrom
3,207,551 A 9/1965 Axtell
3,246,928 A 4/1966 Haynes et al.
3,278,227 A 10/1966 Rowland
3,291,523 A 12/1966 Krueger
3,291,529 A 12/1966 Straits
D209,742 S 1/1968 Gass
3,402,963 A 9/1968 Fujioka et al.
D212,943 S 12/1968 Parker
D218,681 S 9/1970 Jakobsen
D218,682 S 9/1970 Jakobsen
3,610,686 A 10/1971 Cruso
3,639,001 A 2/1972 Anderson
3,669,496 A 6/1972 Chisholm
3,669,497 A 6/1972 Massonnet
3,708,202 A 1/1973 Brecki et al.
3,847,433 A 11/1974 Acton et al.
3,899,207 A 8/1975 Mueller
4,057,288 A 11/1977 Schwartz et al.
4,400,031 A 8/1983 DeDecker
4,456,296 A 6/1984 Rowland
4,549,764 A 10/1985 Haedo
4,580,836 A 4/1986 Verney
4,603,904 A 8/1986 Telleson et al.
4,639,042 A 1/1987 Lange
4,648,653 A 3/1987 Rowland
4,655,504 A 4/1987 Weber
4,790,595 A 12/1988 Hensel et al.
4,852,944 A 8/1989 Hartmann
4,869,552 A 9/1989 Telleson et al.
4,962,964 A 10/1990 Snodgrass
4,978,168 A 12/1990 Piretti
5,002,337 A 3/1991 Engel et al.
5,039,163 A 8/1991 Telleson
5,064,247 A 11/1991 Clark et al.
5,071,191 A 12/1991 Leib
5,123,702 A 4/1992 Caruso
5,110,186 A 5/1992 Clark et al.
5,248,186 A 9/1993 Steinfeld et al.
5,282,669 A 2/1994 Barile
D345,477 S 3/1994 Infanti
D345,478 S 3/1994 Infanti
D345,479 S 3/1994 Infanti
5,308,146 A * 5/1994 Chou ..... A47C 3/04 297/118
5,383,712 A 1/1995 Perry
D358,503 S 5/1995 Ginat
5,626,394 A * 5/1997 Perry ..... A47C 3/04 297/239
D394,358 S 5/1998 De Blaay
5,860,697 A 1/1999 Fewchuk
5,863,096 A * 1/1999 Bartlmae ..... A47C 1/124 297/232
5,902,012 A 5/1999 Han
D411,397 S 6/1999 Arango
5,961,184 A 10/1999 Balden et al.
5,997,084 A 12/1999 Barile et al.
D418,322 S 1/2000 Hock
6,050,646 A 4/2000 Stenzel et al.
D425,717 S 5/2000 Tseng
6,106,061 A 8/2000 Caruso et al.
D431,400 S 10/2000 Grove
D432,805 S 10/2000 Smith
D435,977 S 1/2001 Ambasz
D436,457 S 1/2001 Ambasz
6,206,469 B1 3/2001 Caruso et al.
D440,784 S 4/2001 Ambasz
D446,661 S 8/2001 Ambasz
D452,619 S 1/2002 Piretti
D460,300 S 7/2002 Fifield et al.
6,471,293 B2 10/2002 Ware et al.
D465,938 S 11/2002 Huang
D465,940 S 11/2002 Nien
D469,971 S 2/2003 Piretti
6,533,352 B1 3/2003 Glass et al.
D473,727 S 4/2003 Tsai
D476,162 S 6/2003 Finazzi
D477,470 S 7/2003 Haney et al.
D481,879 S 11/2003 Su
D494,792 S 8/2004 Schmitz et al.
6,779,846 B2 8/2004 Spendlove et al.
D495,509 S 9/2004 Breen
D495,891 S 9/2004 Ambasz
D496,547 S 9/2004 Gasser
D497,729 S 11/2004 Peitz et al.
D498,603 S 11/2004 Swy et al.
D503,291 S 3/2005 Lucci et al.
6,886,890 B2 5/2005 Rowland et al.
6,899,396 B2 5/2005 Bales
D505,800 S 6/2005 Lucci et al.
D506,325 S 6/2005 Farber et al.
D506,338 S 6/2005 Gasser
D513,456 S 1/2006 Smith
D515,340 S 2/2006 Gasser
D517,357 S 3/2006 Gasser
D521,264 S 5/2006 Ware et al.
D526,516 S 8/2006 Muller
D526,824 S 8/2006 Muller
7,156,459 B2 1/2007 Ambasz
D536,548 S 2/2007 Peitz et al.
D539,557 S 4/2007 Doughty
D541,069 S 4/2007 Peiz et al.
D544,225 S 6/2007 Canarutti
D544,235 S 6/2007 Chen
D551,460 S 9/2007 Moser
D558,999 S 1/2008 Canarutti
D575,541 S 8/2008 Hayes
D577,215 S 9/2008 Kreiss
D578,790 S 10/2008 Ciani et al.
D581,708 S 12/2008 Su
D599,127 S 9/2009 Smith
D607,655 S 1/2010 Kubryk
D607,657 S 1/2010 Kubryk
7,717,511 B2 5/2010 Huang
D624,327 S 9/2010 Swy
7,998,551 B2 8/2011 Gasser
D649,375 S 11/2011 Lin
D650,196 S 12/2011 Swy et al.
2002/0047298 A1* 4/2002 Brauning ..... A47C 3/04 297/448.1
2002/0053822 A1 5/2002 Ware et al.
2004/0217635 A1* 11/2004 Barile, Sr. ..... A47C 3/04 297/239
2005/0099052 A1* 5/2005 Bertolini ..... A47C 3/04 297/440.1
2005/0264087 A1 12/2005 Diffrient
2007/0222266 A1 9/2007 Lucci et al.
2008/0166515 A1 7/2008 Gasser
2008/0315645 A1 12/2008 Hock
2008/0315646 A1 12/2008 Hock
2013/0038110 A1* 2/2013 Deisig ..... A47C 3/045 297/354.12
2014/0145480 A1* 5/2014 Johnson ..... A47C 3/04 297/239

OTHER PUBLICATIONS

Mity-Lite, "2010 Product Catalog", Mity-Lite Inc, 2010, 36 pages.
Mity-Lite, "Comfort Seating, Banquet Chairs, Classic Series", Mity-Lite Inc, 2011, 2 pages, Orem, UT.
Mity-Lite, "Comfort Seating, Banquet Chairs, Essential Series", Mity-Lite Inc, 2011, 2 pages, Orem, UT.
Mity-Lite, "Comfort Seating, Banquet Chairs, Prestige Series", Mity-Lite Inc, 2011, 2 pages, Orem, UT.
MTS, "Banquet/Stacking Look Book", MTS Seating, Apr. 2010, 8 pages, Temperance, MI.

(56) References Cited

OTHER PUBLICATIONS

Shelby Williams, "Aluminum Action Back Series", http://www.shelbywilliamns.com/images/BQT-14A.JPG, as accessed on Mar. 1, 2002, 17 pages.

* cited by examiner

STACKING CHAIR

PRIORITY CLAIM(S) AND RELATED APPLICATION(S)

Priority is claimed to U.S. Provisional Patent Application Ser. No. 62/251,399, filed Nov. 5, 2015, which is hereby incorporated herein by reference in its entirety.

This is related to U.S. Design patent application Ser. No. 29/544,441, filed Nov. 3, 2015, which is hereby incorporated herein by reference in its entirety.

BACKGROUND

Field of the Invention

The present invention relates generally to stacking chairs.

Related Art

Various types of stacking chair have been proposed. Often, chairs stack on top of one another with an upper chair displaced slightly forward of the lower chair. Thus, as chairs are stacked, each chair is displaced forwardly, moving a center of gravity of the stack forward, and potentially becoming unstable.

SUMMARY OF THE INVENTION

It has been recognized that it would be advantageous to develop a stacking chair system in which stacking chairs can be stacked more vertically, with less forward creep, and with lateral support. The development and improvement of chairs is an ongoing endeavor.

The invention provides a stacking chair system with a plurality of chairs. Each chair comprises a seat and a backrest, and a pair of side legs on each side of the seat. A pair of side supports is separate and discrete with respect to the pair of side legs, and extends from a top of the backrest to a front of the seat. An upper chair is stackable upon a lower chair, with the pair of side legs of the upper chair inside the pair of side supports of the lower chair, and the pair of side legs of the lower chair inside the pair of legs of the upper chair.

In addition, the invention provides a stacking chair comprising a chair frame with a backrest frame extending from a seat frame, and a plurality of legs, including a pair of front legs and a pair of rear legs, extending from the seat frame, and defining a pair of side legs on each side of the seat frame. A seat cushion is carried by the seat frame, and a backrest cushion is carried by the backrest frame. The backrest frame has a pair of uprights extending from the seat frame with a width less than a width of the seat frame and the seat cushion. The backrest cushion has a width less than a width of the seat frame and the seat cushion. A pair of side supports each has a top end coupled to the backrest frame and a bottom end coupled to the seat frame. The top ends of the pair of side supports are closer to a top of the backrest frame than a bottom of the backrest frame. The bottom ends of the pair of side supports are closer to a front of the seat frame than a rear of the seat frame. A pair of gaps is defined between the pair of side supports and the pair of uprights of the backrest frame. The stacking chair defines an upper chair stackable upon a lower chair, with the rear legs of the upper chair insertable through a pair of gaps of the lower chair, and with the pair of rear legs and the seat frame of the upper chair inside of the pair of side supports of the lower chair, and with a pair of side legs of the lower chair nesting inside the pair of side legs of the upper chair.

Furthermore, the invention provides a stacking chair system with a plurality of chairs. Each chair comprises a chair frame with backrest frame extending from a seat frame, and a plurality of legs, including a pair of front legs and a pair of rear legs, extending from the seat frame, and defining a pair of side legs on each side of the seat frame. A seat cushion is carried by the seat frame, and a backrest cushion is carried by the backrest frame. The backrest frame has a pair of uprights extending from the seat frame with a width less than a width of the seat frame and the seat cushion. The backrest cushion has a width less than a width of the seat frame and the seat cushion. The backrest frame has a top spar extending across a top of the backrest frame, and extending laterally beyond the pair of uprights. A pair of side supports each has a top end coupled to the top spar at a top of the backrest frame, and a bottom end coupled to the seat frame. The pair of side supports is separate and discrete with respect to the pair of side legs. Each of the pair of side supports extends from the top of the backrest to the front of the seat in a forward direction and in a downward direction within a vertical flat planar layer, without extending laterally. A thickness of a member forming a side support and a thickness of a vertically oriented planer layer containing the side support are the same. The bottom ends of the pair of side supports are closer to a front of the seat frame than a rear of the seat frame. The pair of side supports is laterally off-set from the pair of uprights of the backrest frame and the backrest cushion to define a pair of gaps between the pair of side supports and the pair of uprights of the backrest frame. An upper chair is stackable upon a lower chair, with the rear legs of the upper chair insertable through a pair of gaps of the lower chair, the pair of side legs of the upper chair inside the pair of side supports of the lower chair, and the pair of side legs of the lower chair inside the pair of legs of the upper chair.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
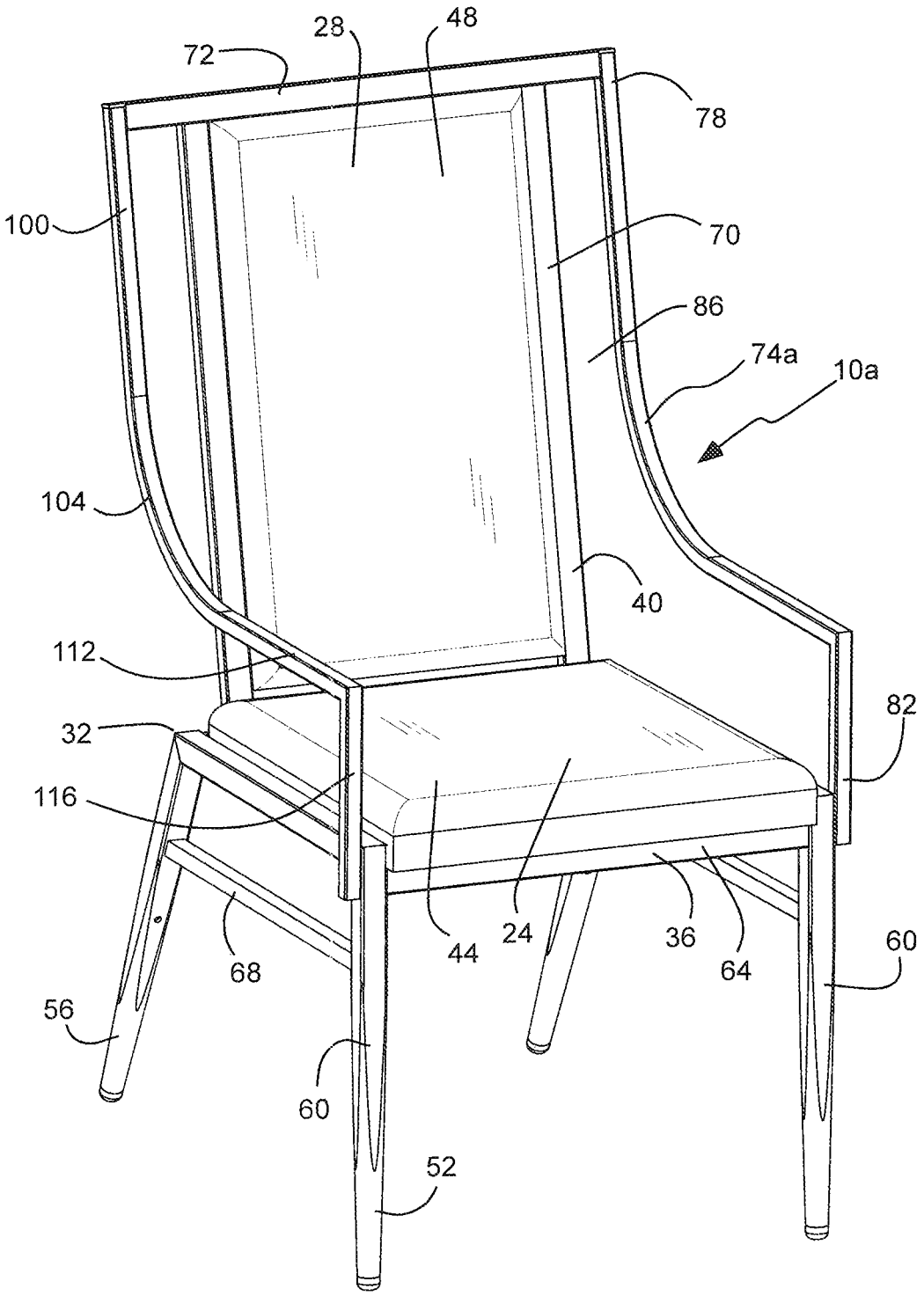
FIG. 1 is a perspective view of a stacking chair in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

In an embodiment of the invention, a stacking chair or stacking chair system that allows a plurality of chairs to be stacked together to save space. In addition, the chairs can be stacked substantially vertical to resist tipping, and to maintain the horizontal location (lateral and fore and aft) of the center of gravity. In addition, the chairs can provide lateral support for the adjacent stacked chair. In addition, the chairs can have side supports to support the backrest with respect to the seat and/or legs, while accommodating the stacking of the chairs. In one aspect, the side supports can also provide an arm rest. In addition, the side supports can be thin and straight to save space. Furthermore, the backrest can be sized and shaped to provide a gap to receive the legs of an upper chair therethrough. In one aspect, the chairs can be banquet chairs.

As illustrated in FIGS. 1-7, a stacking chair system, indicated generally at 8, in an example implementation in accordance with the invention is shown with a plurality of stacking chairs, indicated at 10*a*. The stacking chairs can be stacked one on top of another to form a stack of chairs 14, including at least an upper chair 18 and a lower chair 20. Although only two chairs are shown stacked in the stack 14 for clarity in FIG. 3, it is understood that multiple chairs can be disposed in the stack.

The chairs 10*a* each have a seat 24 and a backrest 28 carried by and supported by a chair frame 32. The chair frame 32, or the seat 24 and backrest 28 respectively, can have a seat frame 36 and a backrest frame 40 extending from the seat frame. The seat 24 has a seat cushion 44 disposed on and carried by the seat frame 36. Similarly, the backrest 28 has a backrest cushion 48 disposed on and carried by the backrest frame 40. The seat cushion 44 and the backrest cushion 48 can comprise a foam covered by a cover, such as a fabric. In addition, the foam can be carried by a substrate or a backing that is rigid. In one aspect, the seat and backrest frames 36 and 40 can be exposed by the seat and backrest cushions 44 and 48, respectively (so that the seat and backrest frames 36 and 40 have a width wider than the seat and backrest cushions 44 and 48, respectively). The backrest 28 and the seat 24 can be rigidly affixed to one another to retain their relative orientations to one another.

The chair and the chair frame can also have a plurality of legs carrying the seat frame, and thus the backrest frame. The chair and the chair frame can have a pair of front legs 52 and a pair of rear legs 56 extending from the seat frame, or a pair of right legs and a pair of left legs. The legs can define a pair of side legs 60 on each side of the seat frame 36, or chair frame 32. The pair of side legs 60 can taper outward and downwardly, and in the fore and aft direction with respect to the chair (i.e. wider at the bottom and narrower at the top) to form a concave indentation between the legs oriented downwardly. In addition, the front legs can be spaced-apart further than the rear legs, and thus the seat frame and the seat can taper inwardly from the front to the back. In one aspect, each of the pair of side legs can be formed by separate members (front, back and top) welded or otherwise joined together. In another aspect, each of the pair of side legs 60 can be formed by a single member bent to form the front and rear leg of each side. The seat frame 36 can be formed at least partially by or defined by the tops of the pair of side legs 60 connected by a front spar 64 and a rear spar 66. In addition, a side spar 68 can extend between a front leg and a rear leg of each of the pair of side legs 60*a* and 60*b*.

The backrest frame 40 comprises a pair of uprights 70 that extend from the seat frame 36. In one aspect, the pair of uprights 70 can be affixed to and can extend from the rear spar 66 of the seat frame 36. The pair of uprights 70 are spaced-apart from one another. The backrest cushion 48 is carried by and between the pair of uprights 70. The backrest frame 40 also has a top spar 72 extending across a top of the backrest frame and across tops of the pair of uprights 70. In addition, the top spar 72 extends laterally beyond the pair of uprights 70. The seat frame 32, the chair frame 36, backrest frame 40 and/or the legs 60 (and/or side supports described below) can be formed of members, such as metal tubes, and can be formed by cutting, bending and welding various members.

The chair 10*a* and the chair frame 32 can also have a pair of side supports 74*a* extending between the backrest frame 40 and the seat frame 36. The side supports 74*a* can help provide support to stabilize and maintain the orientation of the backrest. As described above, the backrest frame and the uprights thereof can be coupled to the seat frame or rear spar thereof, and can produce torsion on the seat frame or rear spar. Thus, the side supports can help reduce the torsion applied by the upright on the rear spar. The side supports 74*a* can have top ends 78 coupled to and extending from the backrest frame 40, and bottom ends 82 extending to and coupled to the seat frame 36. The pair of side supports 74*a* extend from at least closer to the top of the backrest frame 40 than the bottom of the backrest frame, and to at least closer to the front of the seat frame 36 than to the rear of the seat frame.

The top ends 78 of the pair of side supports 74*a* can be coupled to the backrest frame 40 closer to the top of the backrest frame than a bottom of the backrest frame. In one aspect, the top ends 78 of the side supports 74*a* can be coupled to and can extend from the top of the backrest frame 40 and the top spar 72 thereof. The bottom ends 82 of the pair of side supports can be coupled to the seat frame 36 closer to a front of the seat frame than a rear of the seat frame. The pair of side supports 74*a* can extend to a point forward of a midpoint of the seat frame 36. In one aspect, the bottom ends 82 of the pair of side supports 74*a* can extend to and can be coupled to the front of the seat frame 36. The bottoms 82 of the pair of side supports 74*a* can contact the seat frame 36 only at a forward portion of the seat frame, closer to the front of the seat frame than a rear of the seat frame, and without contacting a rear portion of the seat frame or the backrest frame. Attaching the side supports closer to the top of the backrest frame and the front of the seat frame can reduce stress on the side supports. The bottom ends 82 of the side supports 74*a* can be attached to a lateral side or outside of the seat frame 36. The pair of side supports 74*a* can be separate and discrete with respect to the seat and/or seat frame, the backrest and/or the backrest frame, and/or the pair of side legs 60. Thus, the pair of legs can be formed independently with respect to other components to facilitate manufacture of the seat frame.

The pair of side supports 74*a* can be laterally off-set from the backrest frame 40 and the uprights 70 and the backrest cushion 48. A pair of gaps 86 can be defined between the pair of side supports 74*a* and the pair of uprights 70 of the backrest frame 40. The backrest frame 40, the backrest 28 and/or the backrest cushion 48 can have a width less than a width of the seat frame 36 and the seat cushion 44 (or the seat 24). Similarly, the pair of uprights 70 can have a width less than the width of the seat frame 36 and the seat cushion 44. The narrower width of the backrest 28 or the pair of uprights 70 can define the gaps 86 between the side supports 74*a* and the backrest or the uprights.

Figure 2:
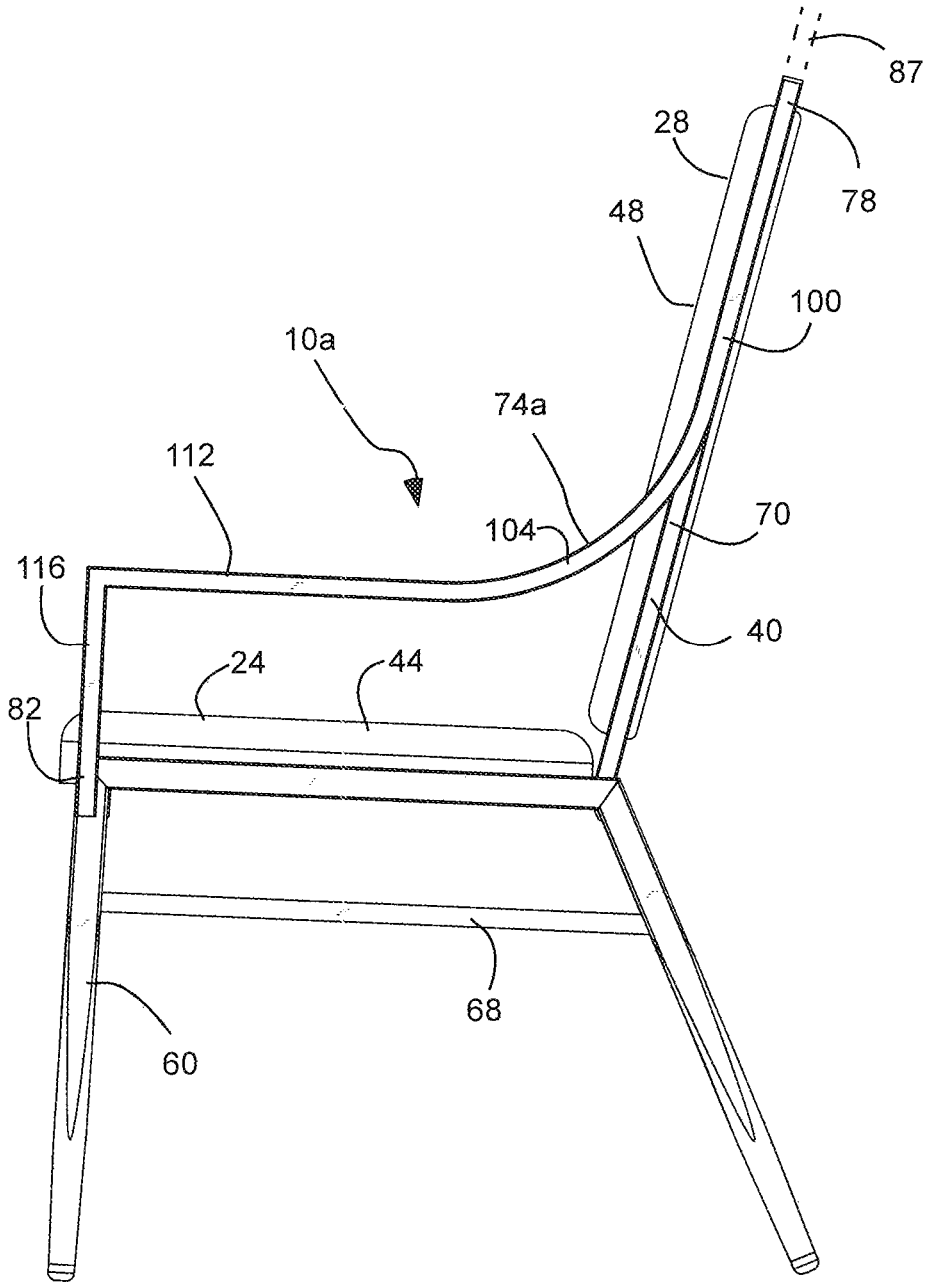
FIG. 2 is a side view of the stacking chair of FIG. 1.
Figure 3:
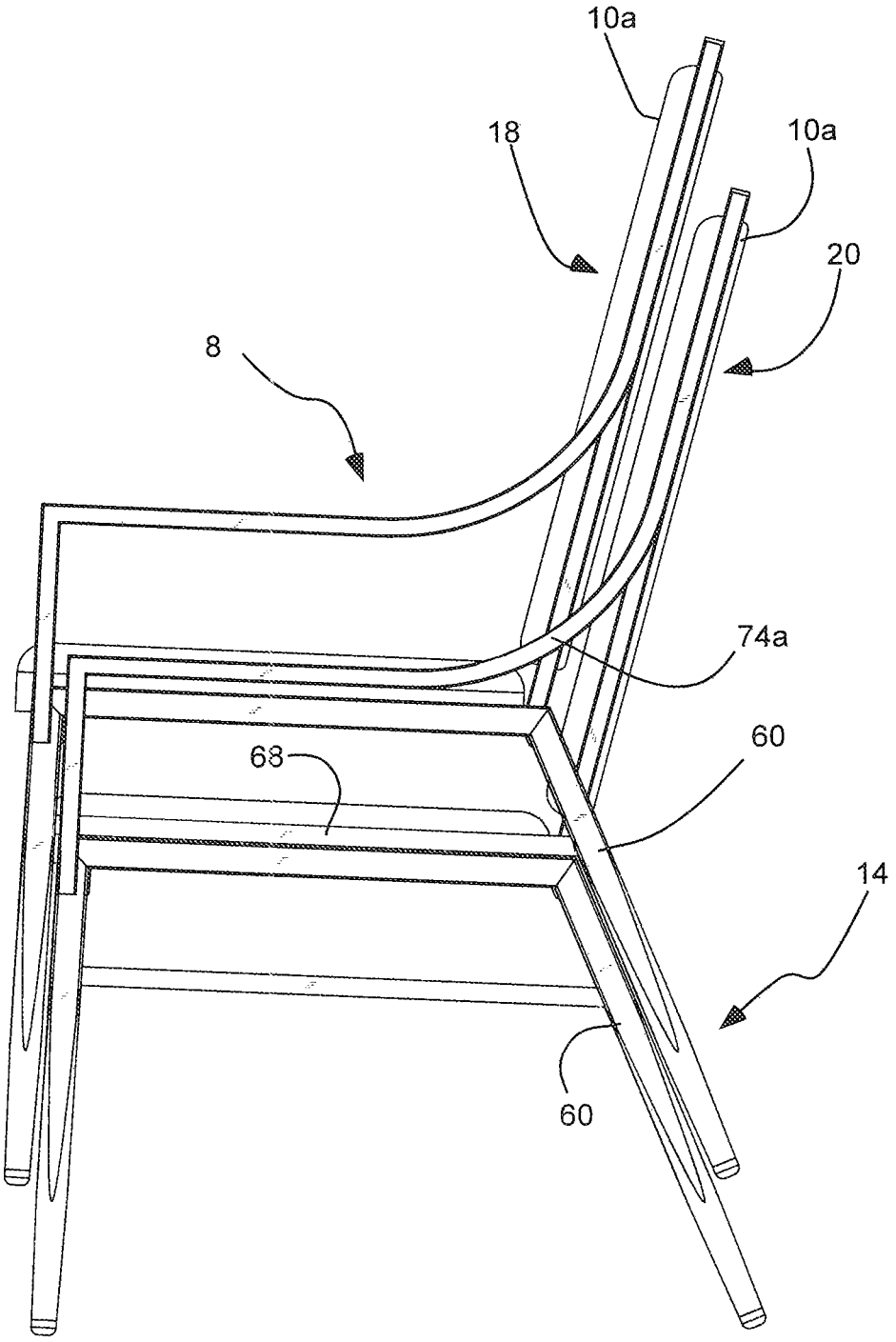
FIG. 3 is a side view of the stacking chair of FIG. 1 shown with another stacking chair in a stacked configuration, and also showing a stacking chair system in accordance with an embodiment of the invention.
Figure 4:
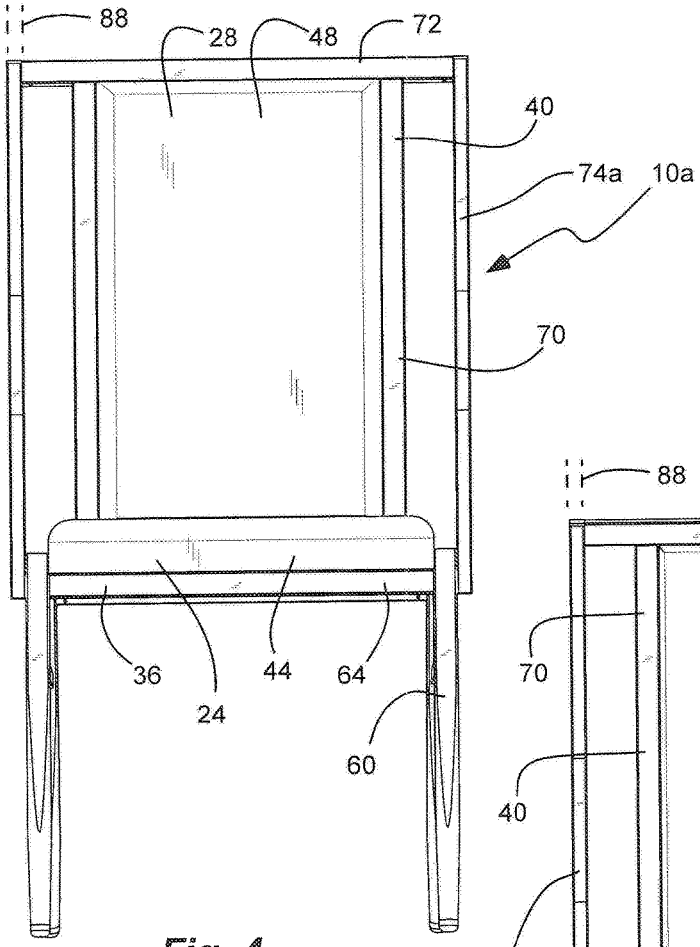
FIG. 4 is a front view of the stacking chair of FIG. 1.
Figure 5:
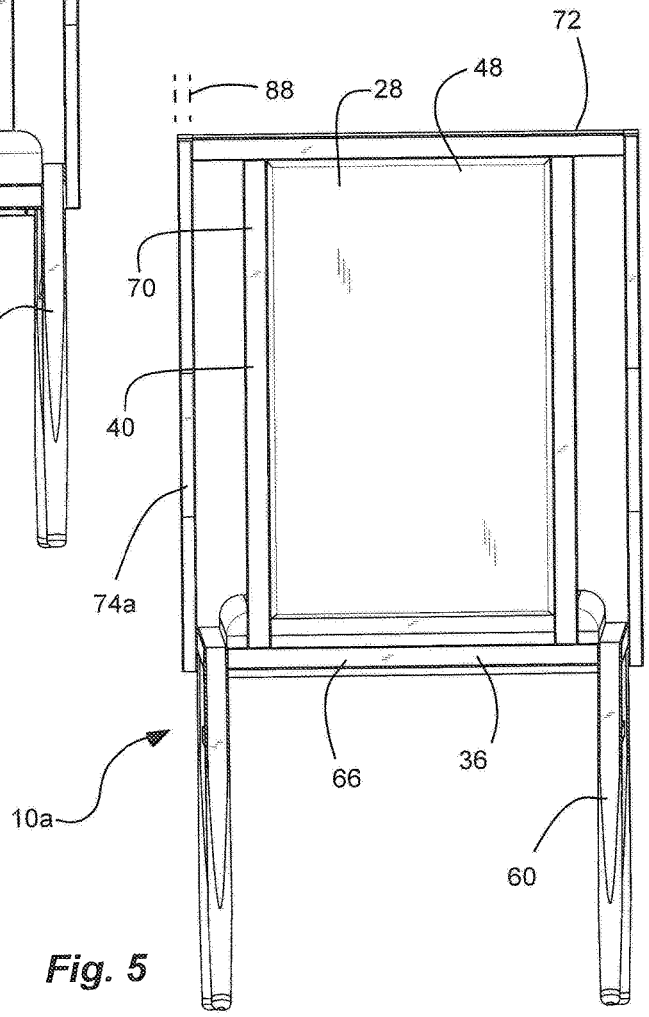
FIG. 5 is a back view of the stacking chair of FIG. 1.
Figure 6:
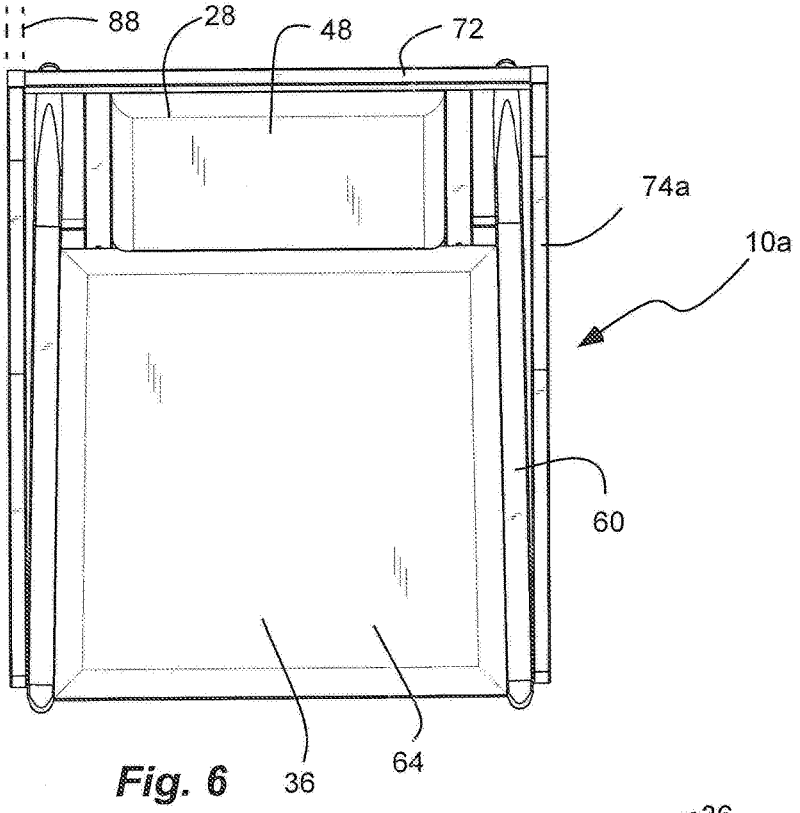
FIG. 6 is a top view of the stacking chair of FIG. 1.
Figure 7:
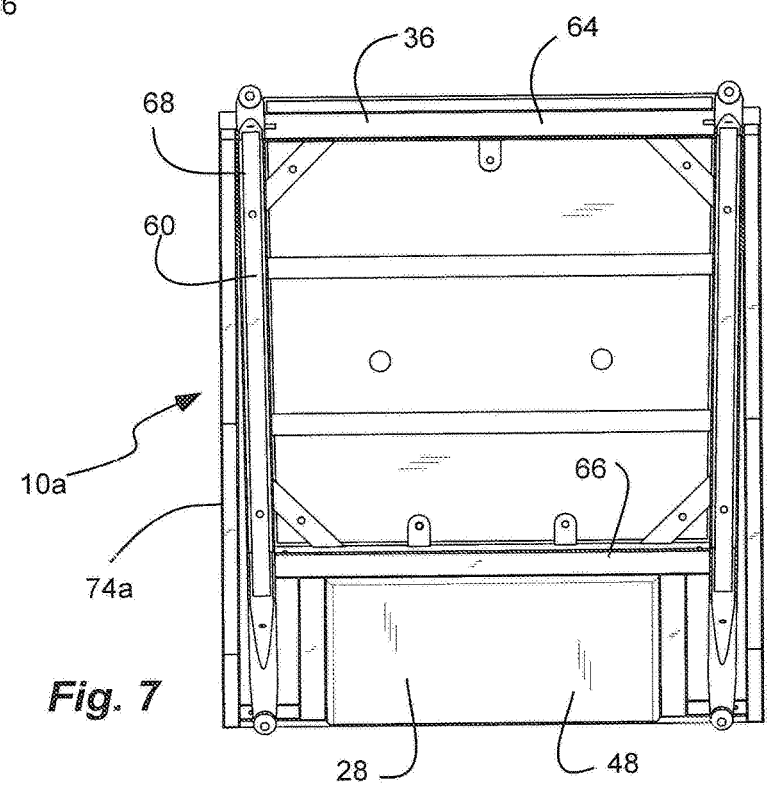
FIG. 7 is a bottom view of the stacking chair of FIG. 1.
Figure 8:
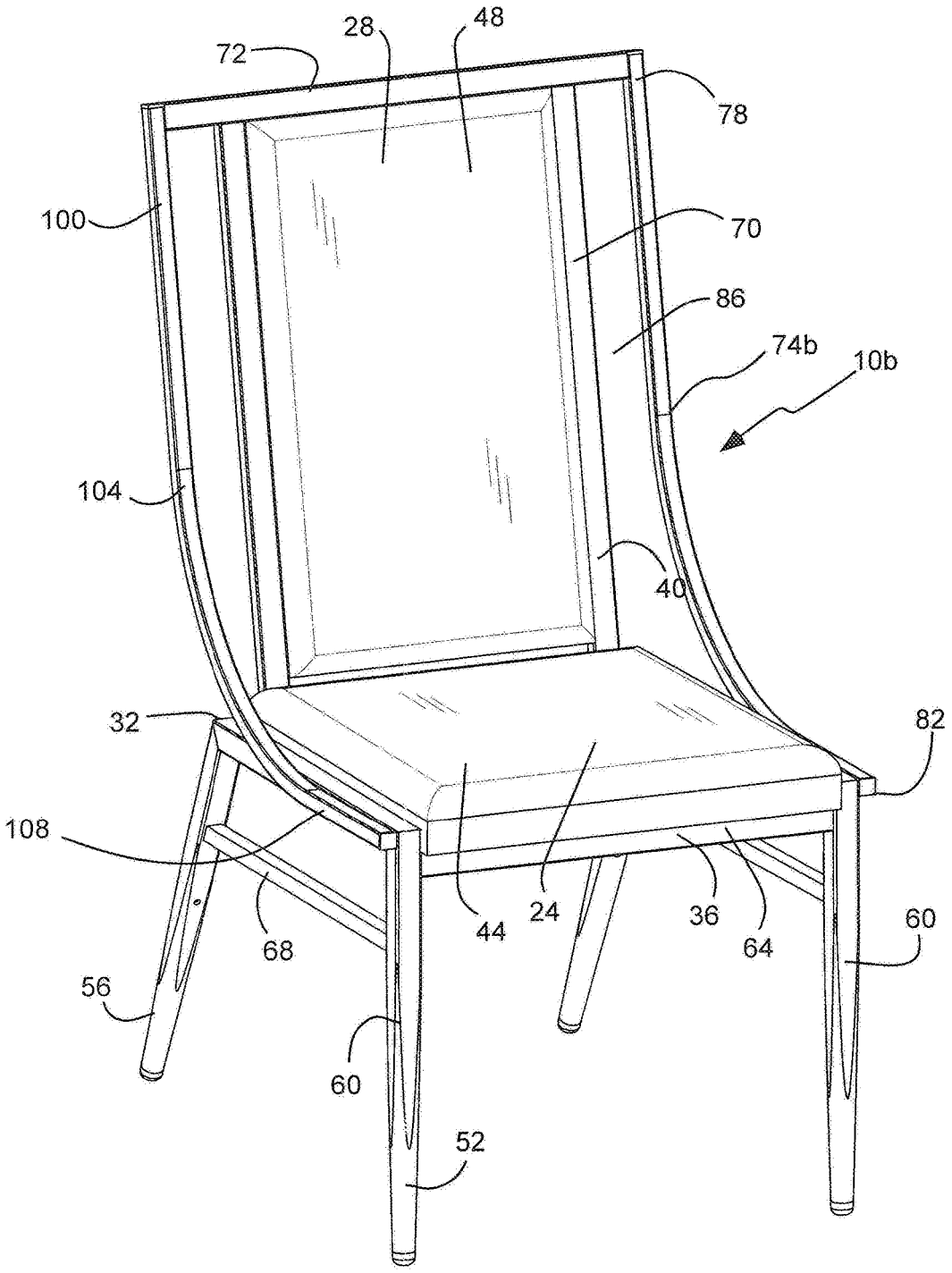
FIG. 8 is a perspective view of another stacking chair in accordance with another embodiment of the invention.
Figure 9:
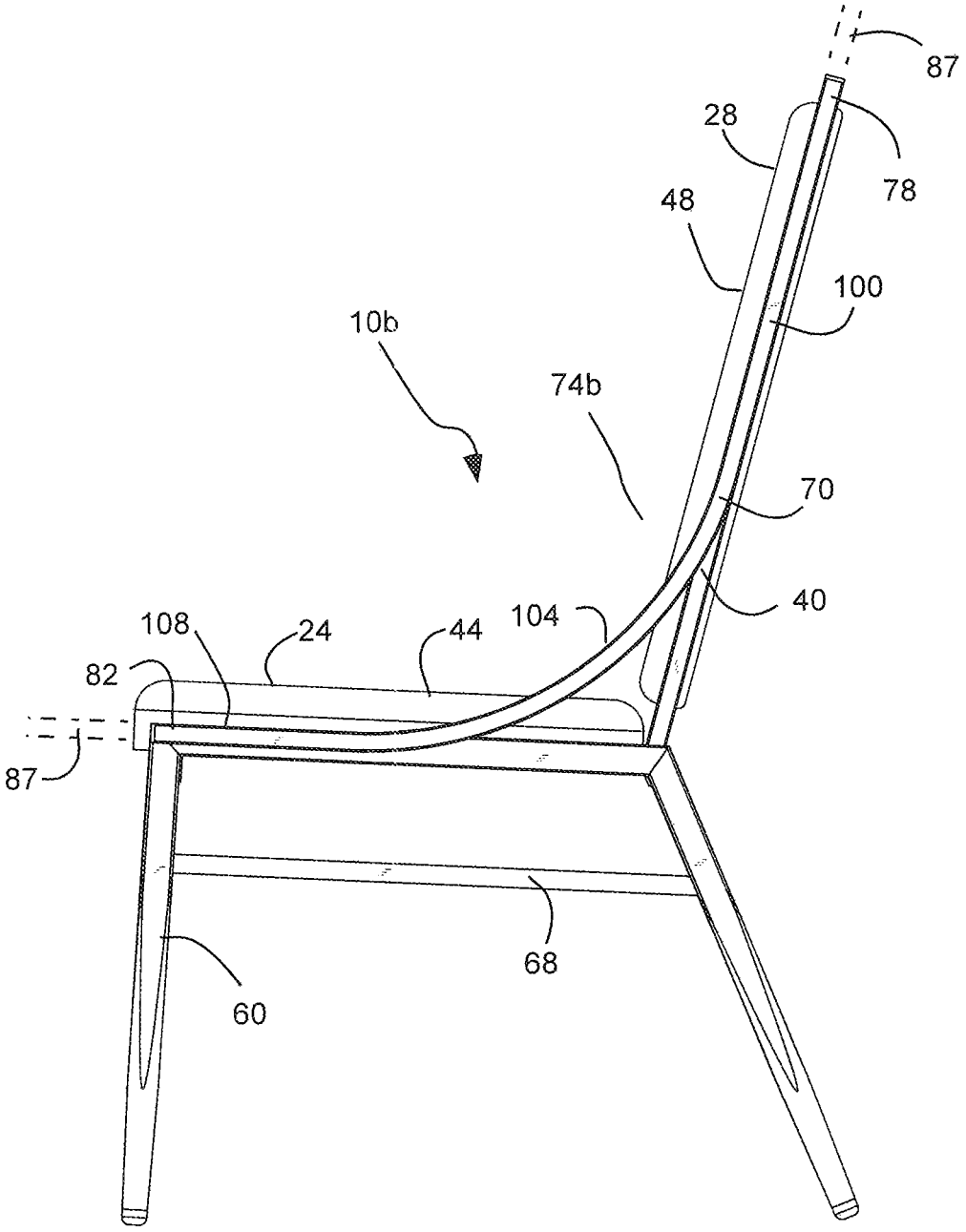
FIG. 9 is a side view of the stacking chair of FIG. 8.
Figure 10:
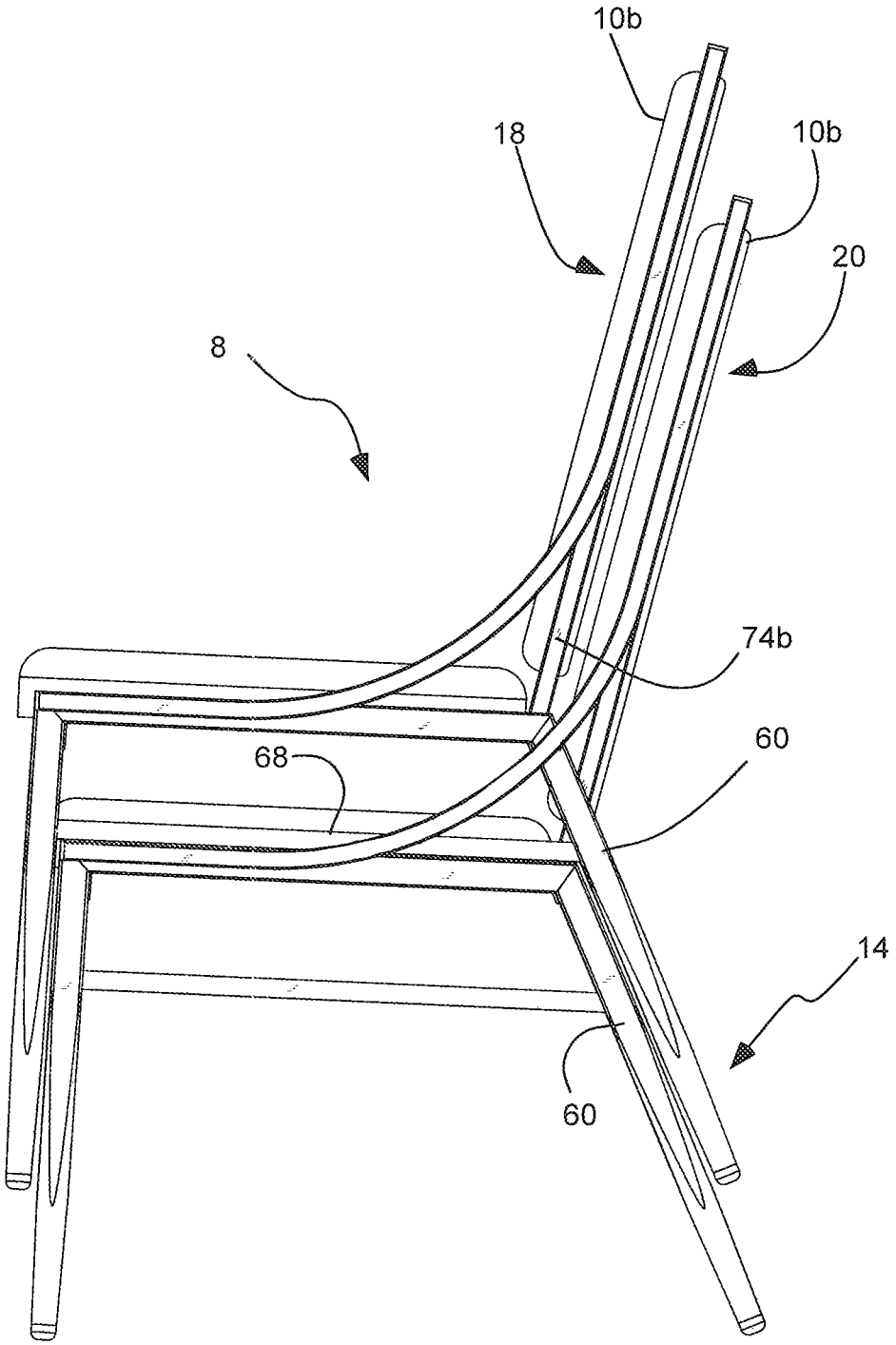
FIG. 10 is a side view of the stacking chair of FIG. 8 shown with another stacking chair in a stacked configuration, and also showing a stacking chair system in accordance with an embodiment of the invention.
Figure 11:
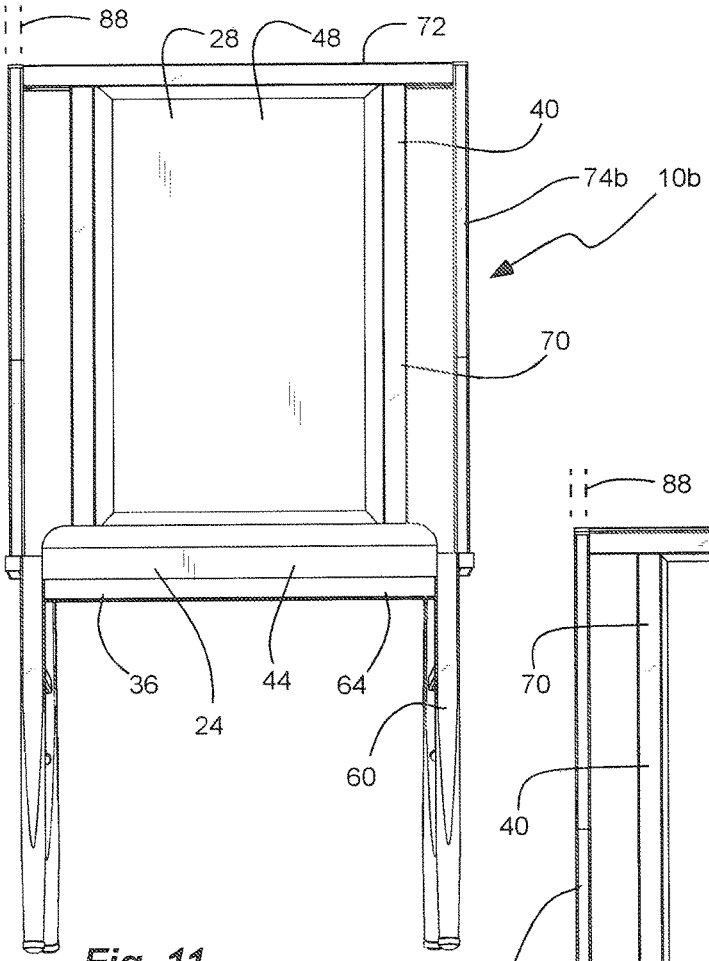
FIG. 11 is a front view of the stacking chair of FIG. 8.
Figure 12:
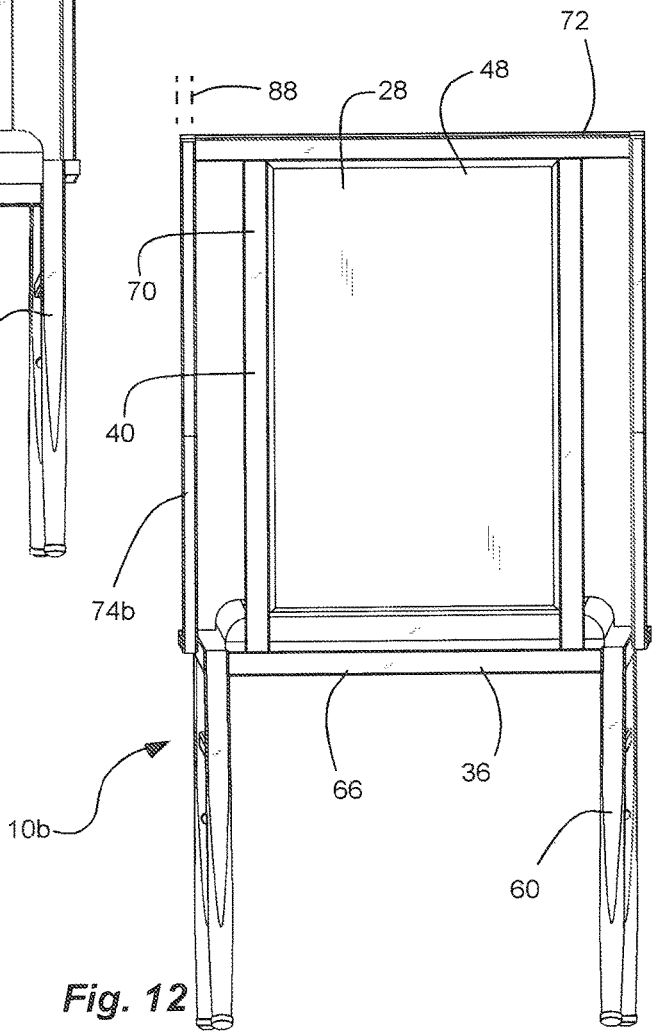
FIG. 12 is a back view of the stacking chair of FIG. 8.
Figure 13:
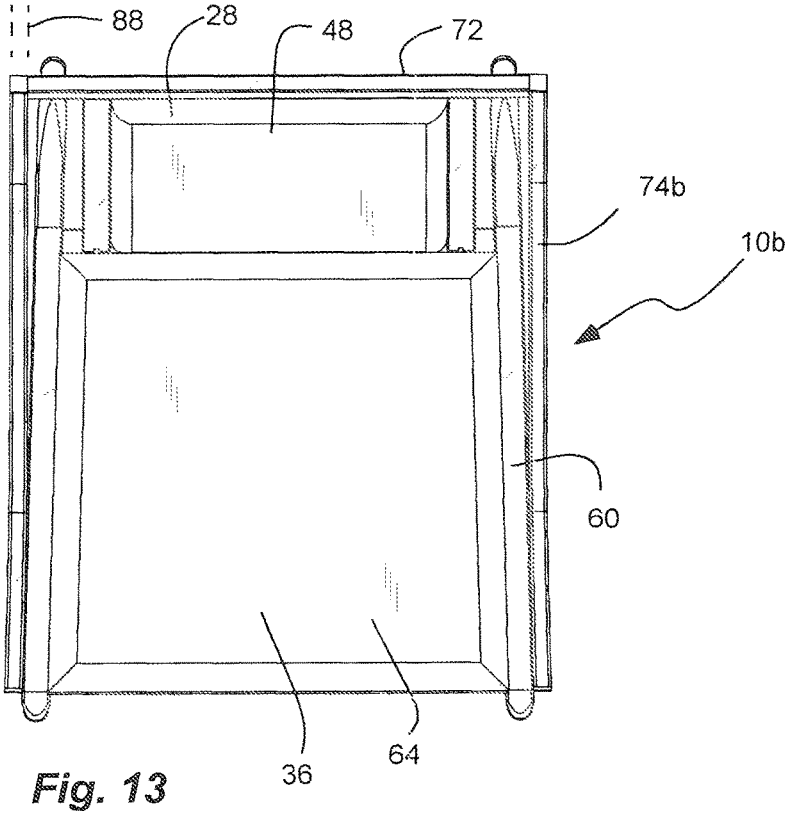
FIG. 13 is a top view of the stacking chair of FIG. 8.
Figure 14:
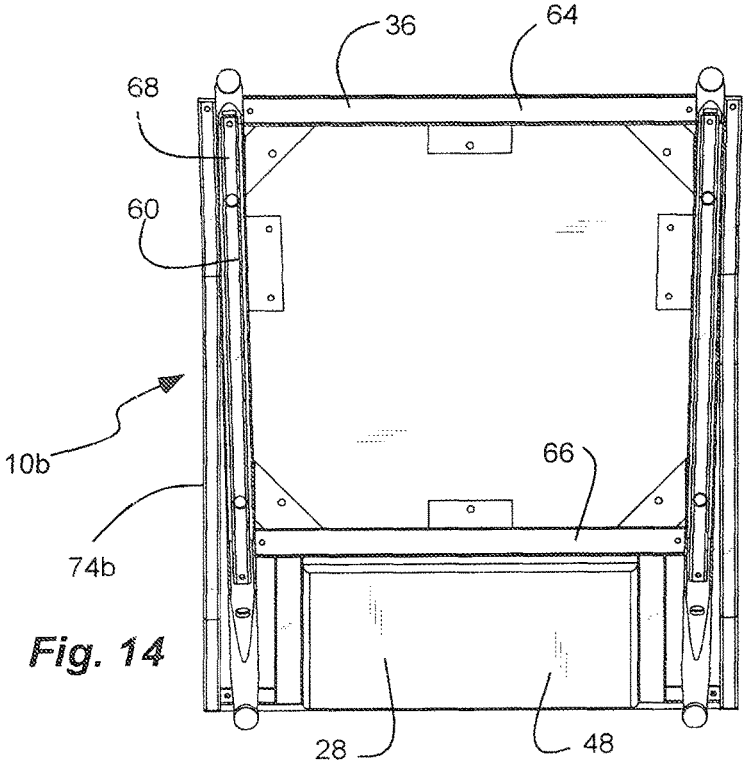
FIG. 14 is a bottom view of the stacking chair of FIG. 8.

In one aspect, the pair of side supports 74*a* can have upper portions or the top ends 78, and/or lower portions or the bottom ends 82 disposed in a planar layer 87 defined by the backrest frame 40 (or the uprights 70) and the seat frame 36, respectively, as shown in FIGS. 2 and 9. Thus, a greater portion of the bottom ends 82 of the side supports can be coupled to the seat frame (as shown in FIG. 9), and the top ends 78 of the side supports allow for stacking. The upper portion or top ends 78 of the pair of side supports 74*a* can extend in the plane 87 defined by the backrest frame 40 from the top of the backrest frame, through at least a midpoint of the backrest frame. The pair of side supports can be any shape, such as arcuate and oriented concave with respect to an outer direction (forward and upward), multiple linear portions joined together in sequence, arcuate but oriented convex with respect to the outer direction, etc.

In another aspect, the pair of side supports 74*a* can extend from the backrest 28 or backrest frame 40 to the seat 24 or seat frame 36 in a forward direction and in a downward direction within a substantially vertical and substantially flat planar layer 88. In another aspect, the pair of side supports can extend within a vertical flat planar layer, without extending laterally. A thickness of a member forming the side support and a thickness of the vertically oriented planer layer 88 containing the side support can be substantially the same. Thus, each of the pair of side supports is disposed within the substantially flat planar layer. The substantially flat planar layer 88 can be oriented substantially vertically and located bordering the chair frame 32 or the seat frame 36. The thickness of the flat planar layer is defined by the thickness (such as width or diameter) of the member forming the side support itself. The member forming the side support or the side support itself is shaped within the vertically oriented planer layer 88, without extending laterally, and without its shape exceeding the width of the member. Thus, the side supports 74 can be thin and flat to facilitate forming the gap 86.

In one aspect, each of the pair of side supports 74*a* can comprise: 1) an upper portion 100 oriented upright and substantially vertically, and having the top end 78 coupled to the backrest frame 40 or the top spar 72 thereof; 2) an intermediate portion 104 extending forwardly from the upper portion 100; 3) an intermediate horizontal portion 112 extending forwardly from the intermediate portion 104 and oriented horizontally, and defining an arm rest; and 4) a lower portion 116 extending downwardly from the arm rest 112 and oriented upright and substantially vertically, and having the bottom end 82 coupled to the seat frame 36.

As indicated above, an upper chair 18 can be stackable upon a lower chair 20, with the pair of side legs 60 of the upper chair 18 inside the pair of side supports 74*a* and 74*b* of the lower chair 20, and the pair of side legs 60 of the lower chair 20 inside the pair of legs 60 of the upper chair 18. The rear legs of the upper chair 18 can be insertable through the pair of gaps 86 of the lower chair 20. The pair of rear legs and the seat frame 36 of the upper chair 18 can be inside of the pair of side supports 74*a* and 74*b* of the lower chair 20. The pair of side legs 60 of the lower chair 20 can nest inside the pair of side legs 60 of the upper chair 18. The pair of legs 60 of the upper chair 18 can rest on the pair of legs 60 of the lower chair 20. And the side spar 68 of the upper chair 18 can rest on or above the seat frame 36 of the lower chair 20.

Referring to FIGS. 8-14, a stacking chair system, indicated generally at 8*b*, in an example implementation in accordance with the invention is shown with a plurality of stacking chairs, indicated at 10*b*, which are similar in many respects to those described above, and which description is incorporated herein by reference. The chair 10*b* can have a pair of side supports 74*b* that extend from the top of the backrest frame 40 to the front of the seat frame 36, and contact only a top of the backrest frame and only a front of the seat frame. In one aspect, the bottoms 82 of the pair of side supports 74*b* contact the seat frame 36 only at a forward portion of the seat frame, closer to a front of the seat frame than a rear of the seat frame, and without contacting a rear portion of the seat frame or the backrest frame.

In one aspect, the pair of side supports 74*b* can extend from the backrest 28 or backrest frame 40 to the seat 24 or seat frame 36 in a forward direction and in a downward direction within a substantially vertical and substantially flat planar layer 88. A thickness of a member forming the side support and a thickness of the vertically oriented planer layer 88 containing the side support can be substantially the same. Thus, each of the pair of side supports is disposed within the substantially flat planar layer. The side supports 74*b* can have a slight angle inwardly from the bottom to align with the seat frame whose side rails (or tops of the pair of side legs) angle inward towards rear of chair. Thus, the bottom end can be flush with the seat frame and welded to the seat frame. In one aspect, the side supports can angle less than 5 degrees from top to bottom. In another aspect, the side supports can angle less than 3 degrees from top to bottom. In another aspect, the side supports can angle approximately 2 degrees between the bottom and top.

In one aspect, each of the pair of side supports 74*b* can comprise: 1) an upper portion 100 oriented upright and substantially vertically, and having the top end 78 coupled to the backrest frame 40 or the top spar 72 thereof; 2) an intermediate portion 104 extending forwardly from the upper portion 100; and 3) a lower portion 108 extending forwardly from the intermediate portion 104, and oriented horizontally and having the bottom end 82 coupled to the seat frame 36. As described above, the lower portion 108 can be flush with the seat frame 36 and welded thereto, and can angle from the bottom end to the top end between 2-5 degrees.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A stacking chair device, comprising:

a) a chair frame with a backrest frame extending from a seat frame, and a plurality of legs, including a pair of front legs and a pair of rear legs, extending from the seat frame, and defining a pair of side legs on each side of the seat frame;

b) a seat cushion carried by the seat frame and a backrest cushion carried by the backrest frame;

c) the backrest frame having a pair of uprights extending from the seat frame with a width less than a width of the seat frame and the seat cushion, and the backrest cushion having a width less than a width of the seat frame and the seat cushion;

d) a pair of side supports each having a top end coupled to the backrest frame and a bottom end coupled to the seat frame;

e) the top ends of the pair of side supports being closer to a top of the backrest frame than a bottom of the backrest frame;

f) the bottom ends of the pair of side supports being closer to a front of the seat frame than a rear of the seat frame;

g) a pair of gaps defined between the pair of side supports and the pair of uprights of the backrest frame;

h) each of the pair of side supports comprising:

an upper portion oriented upright and substantially vertically;

an intermediate portion extending forwardly from the upper portion;

an intermediate horizontal portion extending forwardly from the intermediate portion and oriented substantially horizontally, and defining an arm rest; and a lower portion extending downwardly from the arm rest and oriented upright and substantially vertically; and i) the stacking chair defining an upper chair stackable upon a lower chair, with the rear legs of the upper chair insertable through a pair of gaps of the lower chair, and with the pair of rear legs and the seat frame of the upper chair inside of the pair of side supports of the lower chair, and with a pair of side legs of the lower chair nesting inside the pair of side legs of the upper chair.

2. The device in accordance with claim 1, wherein each of the pair of side supports extends from the backrest to the front of the seat within a substantially vertical and substantially flat planar layer.

3. The device in accordance with claim 1, wherein a thickness of a member forming a side support and a thickness of a vertically oriented planer layer containing the side support are the same.

4. The device in accordance with claim 1, wherein the bottoms of the pair of side supports contact the seat frame only at a forward portion of the seat frame closer to a front of the seat frame than a rear of the seat frame, and without contacting a rear portion of the seat frame or the backrest frame.

5. The device in accordance with claim 1, wherein the pair of side supports extend from closer to the top of the backrest frame than the seat cushion, and to closer to the front of the seat frame than to the rear of the seat frame.

6. The device in accordance with claim 1, wherein the pair of side supports extend from the top of the backrest frame to a point forward of a midpoint of the seat frame.

7. The device in accordance with claim 1, wherein the pair of side supports extend from the top of the backrest frame to the front of the seat frame, and contact only a top of the backrest frame and only a front of the seat frame.

8. The device in accordance with claim 1, wherein the bottoms of the pair of side supports are attached outside of the seat frame.

9. The device in accordance with claim 1, wherein a top portion of the pair of side supports is in a planar layer defined by the pair of uprights.

10. The device in accordance with claim 1, wherein the pair of side supports is laterally off-set from the pair of uprights of the backrest frame and the backrest cushion; and wherein the tops of the side supports are attached to the backrest frame by a top spar extending across a top of the backrest frame and tops of the side supports.

11. The device in accordance with claim 1, wherein an upper portion of the pair of side supports extends in a plane defined by the backrest from a top of the backrest frame through at least a midpoint of the backrest frame.

12. A stacking chair system with a plurality of chairs each comprising:

a) a chair frame with a backrest frame extending from a seat frame, and a pair of side legs on each side of the seat frame;

b) a seat cushion carried by the seat frame and a backrest cushion carried by the backrest frame;

c) the backrest frame having a pair of uprights extending from the seat frame with a width less than a width of the seat frame and the seat cushion, and the backrest cushion having a width less than a width of the seat frame and the seat cushion;

d) a pair of side supports separate and discrete with respect to the pair of side legs, and extending from a top of the backrest to a front of the seat; and e) a pair of gaps defined between the pair of side supports and the pair of uprights of the backrest frame;

f) each of the pair of side supports comprising:

i) an upper portion oriented upright and substantially vertically and having the top end coupled to the backrest frame;

ii) an intermediate portion extending forwardly from the upper portion; and iii) a lower portion extending forwardly from the intermediate portion and oriented substantially horizontally and having the bottom end coupled to the seat frame; and g) an upper chair stackable upon a lower chair, with the pair of side legs of the upper chair inside the pair of side supports of the lower chair, and the pair of side legs of the lower chair inside the pair of legs of the upper chair.

13. The system in accordance with claim 12, each of the chairs further comprises:

each of the pair of side supports extending from the top of the backrest to the front of the seat in a forward direction and in a downward direction within a substantially vertical and substantially flat planar layer.

14. The system in accordance with claim 12, wherein a thickness of a member forming a side support and a thickness of a vertically oriented planer layer containing the side support are the same.

15. The system in accordance with claim 12, wherein each of the pair of side supports extends from the backrest to the front of the seat within a substantially vertical and substantially flat planar layer.

16. The system in accordance with claim 12, wherein a thickness of a member forming a side support and a thickness of a vertically oriented planer layer containing the side support are the same.

17. The system in accordance with claim 12, wherein the bottoms of the pair of side supports contact the seat frame only at a forward portion of the seat frame closer to a front of the seat frame than a rear of the seat frame, and without contacting a rear portion of the seat frame or the backrest frame.

18. The system in accordance with claim 12, wherein a top portion of the pair of side supports is in a planar layer defined by the pair of uprights.

19. The system in accordance with claim 12, wherein the pair of side supports is laterally off-set from the pair of uprights of the backrest frame and the backrest cushion; and wherein the tops of the side supports are attached to the backrest frame by a top spar extending across a top of the backrest frame and tops of the side supports.

20. A stacking chair system with a plurality of chairs each comprising:

a) a chair frame with backrest frame extending from a seat frame, and a plurality of legs, including a pair of front legs and a pair of rear legs, extending from the seat frame, and defining a pair of side legs on each side of the seat frame;

b) a seat cushion carried by the seat frame and a backrest cushion carried by the backrest frame;

c) the backrest frame having a pair of uprights extending from the seat frame with a width less than a width of the seat frame and the seat cushion, and the backrest cushion having a width less than a width of the seat frame and the seat cushion;

d) the backrest frame having a top spar extending across a top of the backrest frame and extending laterally beyond the pair of uprights;

e) a pair of side supports each having a top end coupled to the top spar at a top of the backrest frame and a bottom end coupled to the seat frame;

f) the pair of side supports being separate and discrete with respect to the pair of side legs;

g) each of the pair of side supports extending from the top of the backrest to the front of the seat in a forward direction and in a downward direction within a substantially vertical and substantially flat planar layer;

h) a thickness of a member forming a side support and a thickness of the vertically oriented planer layer containing the side support being the same;

i) the bottom ends of the pair of side supports being closer to a front of the seat frame than a rear of the seat frame;

j) the pair of side supports being laterally off-set from the pair of uprights of the backrest frame and the backrest cushion to define a pair of gaps between the pair of side supports and the pair of uprights of the backrest frame; and k) each of the pair of side supports comprising:

an upper portion oriented upright and substantially vertically;

an intermediate portion extending forwardly from the upper portion;

an intermediate horizontal portion extending forwardly from the intermediate portion and oriented substantially horizontally, and defining an arm rest; and a lower portion extending downwardly from the arm rest and oriented upright and substantially vertically; and l) an upper chair stackable upon a lower chair, with the rear legs of the upper chair insertable through a pair of gaps of the lower chair, the pair of side legs of the upper chair inside the pair of side supports of the lower chair, and the pair of side legs of the lower chair inside the pair of legs of the upper chair.

* * * * *